United States Patent [19]

Prince

[11] 4,133,223

[45] Jan. 9, 1979

[54] SINGLE LEVER CONTROL

[75] Inventor: Anthony P. Prince, Waukegan, Ill.

[73] Assignee: Outboard Marine Corporation, Waukegan, Ill.

[21] Appl. No.: 824,041

[22] Filed: Aug. 12, 1977

[51] Int. Cl.[2] ..... G05G 5/06; G05G 9/00

[52] U.S. Cl. ..... 74/538; 74/471 R

[58] Field of Search ..... 74/538, 536, 523, 471 R, 74/504

[56] References Cited

U.S. PATENT DOCUMENTS

| | | | |
|---|---|---|---|
| 2,660,902 | 12/1953 | Wagner | 74/538 X |
| 4,075,907 | 2/1978 | Petrzelka | 74/523 |

*Primary Examiner*—Leonard H. Gerin

*Attorney, Agent, or Firm*—Michael, Best & Friedrich

[57] ABSTRACT

Disclosed herein is a single lever control for marine propulsion devices and the like which control includes a main control lever mounted for rotational movement from a neutral position, a control knob including a laterally extending hand grip portion and removably fastened on the upper end of the main control lever, and a locking mechanism for releasably locking the main control lever in the neutral position. The locking mechanism includes a locking arm slidably mounted on one side of the main control lever for reciprocative movement between a locking position and a released position. The locking arm is moved to a released position by squeezing a lockout button located adjacent the hand grip portion and removably fastened to the upper end of the locking arm. The lockout button includes a pair of laterally spaced slots located on the opposite sides of the main control lever so that the hand grip and the lockout button can be conveniently mounted on either side of the main control lever without relocating the locking arm or removing the main control lever.

10 Claims, 7 Drawing Figures

SINGLE LEVER CONTROL

BACKGROUND OF THE INVENTION

This invention relates to single lever controls. More specifically, the invention relates to single lever controls for regulating the throttle and/or clutch associated with an internal combustion engine for marine propulsion devices, such as outboard motors or stern drive units, and including a neutral locking mechanism.

Such single lever controls typically employ a main control lever having a control knob including a laterally extending hand grip incorporating a depressible button or the like which can be actuated to release the neutral locking mechanism. In order to accommodate the operator's grip preference, the operating clearance between the main control lever and the surrounding parts, etc., it is desirable that the control knob be arranged so that the hand grip can be mounted on either side of the main control lever during initial assembly or its position reversed during use as the need arises. Prior art single lever constructions usually require removal of the main control lever and/or relocation of a portion of the neutral locking mechanism to reverse the position of the hand grip.

SUMMARY OF THE INVENTION

The invention provides a single lever control including a main control lever having an upper end and opposed sides and being mounted for rotational movement relative to a neutral position, locking means for releasably locking the main control lever in the neutral position including a portion which is movable between a locking position and a released position, a control knob including a laterally extending hand grip portion and a lockout button located adjacent the hand grip portion and movable relative thereto between a locking position and a released position, and means for removably fastening the control knob on the upper end of the main control lever and for removably fastening the locking means portion on the lockout button whereby the control knob can be located on either of the opposite sides of the main control lever with a major portion of the hand grip portion and the lockout button extending laterally outwardly therefrom.

The invention also provides a single lever control including a main control lever mounted for rotational movement relative to a neutral position, a control knob including a laterally extending hand grip portion, first fastening means for removably fastening the control knob on the upper end of the main control lever, and locking means for releasably locking the main control lever in a neutral position. The locking means includes a locking arm slidably mounted on one side of the main control lever for reciprocative movement relative to the rotational axis of the main control lever between a locking position and a released position, detent means cooperating with the locking arm for preventing movement of the main control lever from the neutral position when the locking arm is in the locking position and for permitting movement of the main control lever relative to the neutral position when the locking arm is in the released position, and a lockout button located adjacent the hand grip portion of the control knob and movably relative thereto between a locking position and a released position. The lockout button includes first and second laterally spaced slots which are located on the opposite sides of the main control lever and each of which is adapted to receive the upper end of the locking arm such that, when the upper end of the locking arm is received in the first slot, the major portion of the hand grip and the lockout button extends laterally outwardly from one side of the main control lever and, when the upper end of the locking arm is received in the second slot, the major portion of the hand grip and the lockout button extends laterally outwardly from the opposite side of the main control lever.

In one embodiment, the main control lever includes an aperture in the upper end, the hand grip includes a lateral extension which is received in and extends through the main control lever aperture and a portion which abuts one side of the main control lever adjacent the main control lever aperture, the control knob further includes a cover which fits over the hand grip extension and has an inner end which abuts the opposite side of the main control lever adjacent the main control aperture, and the first fastening means removably fastens the cover to the hand grip extension and thereby secures the control knob on the main control lever.

In one embodiment, the main control lever aperture has a noncircular shape and the portion of the hand grip extension extending through the main control lever aperture has a corresponding shape so as to substantially prevent rotation of the control knob relative to the main control lever.

In one embodiment, the upper end of the locking arm includes an aperture alignable with the slots and is removably fastened to the lockout button by a fastening means removably extending into the inner end of the lockout button and through the locking arm aperture.

One of the principal features of the invention is the provision of a single lever control including a main control lever, a neutral locking mechanism, and a control knob removably fastened to the main control lever and having a laterally extending hand grip portion which can be conveniently mounted on either of the opposite sides of the main control lever.

Another of the principal features of the invention is the provision of such a single lever control including a locking arm slidably mounted on one side of the main control lever, a detent means cooperating with the locking arm for releasably locking the main control lever in a neutral position, a lockout button which is located adjacent the hand grip portion of the control knob and is removably fastened to the locking arm in a manner whereby the hand grip portion and the lockout button can be located on either of the opposite sides of the main control lever without relocating the locking arm.

Other features and advantages of the embodiments of the invention will become apparent to those skilled in the art upon reviewing the following detailed description, the drawings, and the appended claims.

BRIEF DESCRIPTION OF THE DRAWINGS

FIG. 7 is a view similar to FIG. 2 illustrating the location of various of the components when the hand grip portion of the control knob is mounted on the opposite side of the main control lever.

Figure 1:
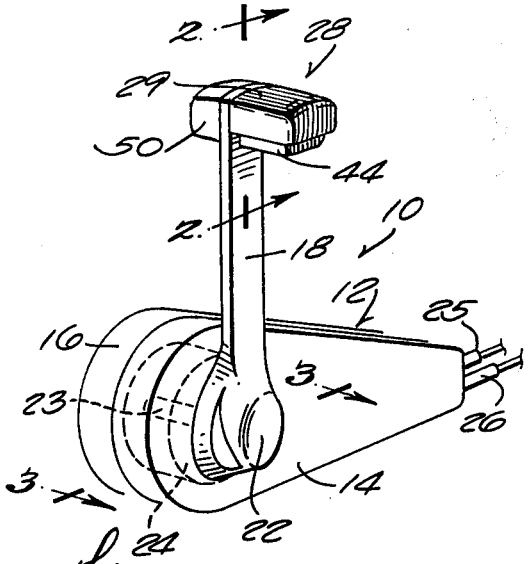
FIG. 1 is a perspective view of a single lever control which is particularly adapted for use with a marine propulsion device and embodies various of the features of the invention.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

GENERAL DESCRIPTION

Illustrated in the drawings is a single lever control for operating the clutch and throttle of a remotely located marine propulsion device, such as an outboard motor or stern drive unit. A single lever control 10 embodying various of the features of the invention includes a housing 12 having opposed sidewalls 14 and 16 and a main control lever 18 located exteriorly of the housing 12.

The main control lever has an upper end 20 and a lower end 22 connected to a shaft member 23 (illustrated diagrammatically in FIG. 1) which is mounted on the housing 12 to afford pivotal or rotational movement of the main control lever 18 relative to the housing 12. The shaft member 23 is operatively connected, through a conventional actuating mechanism 24 (illustrated diagrammatically in FIG. 1), to a pair of push-pull links or cables 25 and 26 which respectively are operatively connected to a remotely located engine throttle and a remotely located engine clutch (neither shown).

Actuation or shifting of the engine clutch occurs, via the push-pull cable 26, in response to a predetermined amount of movement of the main control lever 18 in either rotative direction from the neutral position shown in FIG. 1. Movement of the main control lever 18 beyond a clutch shift position causes sufficient movement of the push-pull cable 25 to advance the engine throttle setting. The specific arrangement of the actuating mechanism 24 located inside the housing 12 and interconnecting the shaft member 23 and the cables 25 and 26 to provide the coordinated movement of the main control lever and the cables 25 and 26 is of conventional design and does not constitute a part of the invention. Accordingly, detailed description and illustration of the same is not necessary for a full understanding of the invention and have been omitted for the sake of brevity.

Movement of the main control lever 18 is facilitated by a control knob 28 removably fastened on the upper end 20 of the main control lever 18 as described below. The control knob 28 includes a hand grip portion 29 extending laterally from one side of the main control lever 18.

Figure 2:
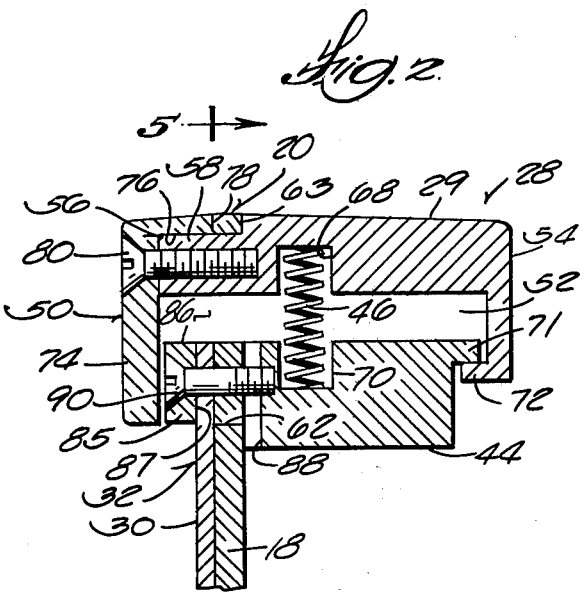
FIG. 2 is an enlarged, fragmentary, sectional view taken generally along line 2—2 in FIG. 1.
Figure 3:
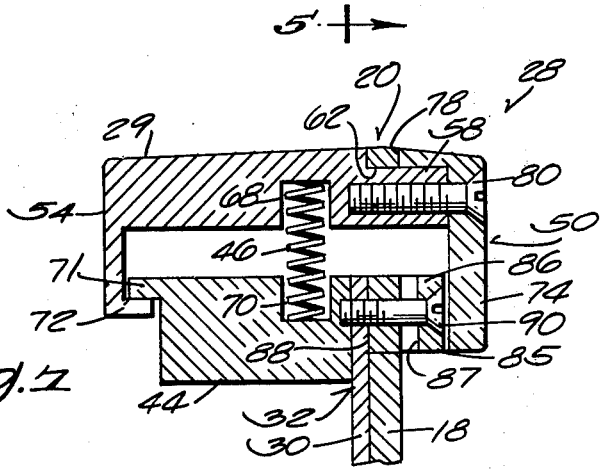
FIG. 3 is an enlarged, fragmentary view taken generally along line 3—3 in FIG. 1.

The main control lever 18 is releasably located in a neutral position by a neutral lock mechanism including a locking slide or arm 30 having an upper end 32 (FIGS. 2, 4, 5 and 6) and a lower end 34 (FIG. 3). The locking arm 30 is slidably mounted on the inner side of the main control lever 18 for reciprocative movement relative to the rotational axis of the main control lever 18 between a locking position and a released position.

Provided on the housing sidewall 14 is a suitable detent mechanism which cooperates with the lower end 34 of the locking arm 30 for preventing movement of the main control lever 18 from the neutral position when the locking arm 30 is in the locking position and for permitting movement of the main control lever 18 relative to the neutral position when the locking arm 30 is in the released position. In the specific construction illustrated, such detent means (see FIG. 3) includes a generally circular plate 36 suitably mounted on the exterior of the housing side wall 14 and interposed the main control lever 18 and the housing side wall 14 coaxially with the shaft member 23. The circular plate 36 has a central aperture 38 through which the shaft member 23 extends and includes a notch 40 located at a position corresponding to the neutral position of the main control lever 18 and adapted to receive the lower end 34 of the locking arm 30 when the locking arm 30 is in the locking position shown. The plate 36 also includes a peripheral edge 42 on which the lower end 34 of the locking arm 30 rides when the locking arm is in the released position and the main control lever 18 is rotated from and toward the neutral position.

Located beneath the hand grip portion 29 of the control knob 28 for movement relative thereto is a lockout button 44 which is removably fastened to the upper end 32 of the locking arm 30. Means are provided for biasing the locking arm 30 toward the locking position, i.e., towards the rotational axis of the main control lever 18 and toward the peripheral edge 42 of the circular plate 36. In the specific construction illustrated, such means includes a compression spring 46 interposed the lockout button 44 and the hand grip portion 29 of the control knob 28.

When movement of the main control lever 18 from the neutral position is desired to actuate the engine clutch and/or advance the engine throttle setting, the locking arm 30 can be moved from the locking position to the released position by gripping the hand grip portion 29 of the control knob 28 and squeezing the lockout button 44 against the biasing force of the spring 46 to retract the lower end 34 of the locking arm 30 from the notch 40 in the plate 36. The main control lever 18 thereafter can be moved in either rotative direction relative to the neutral position. When the lockout button 44 is released after the main control lever 18 has been moved from the neutral position, the spring 46 urges the lower end 34 of the locking arm 30 into engagement with the peripheral edge 42 of the plate 36, permitting free rotation of the main control lever 18 until it is returned to the neutral position at which time the spring 46 urges the lower end 34 of the locking arm 30 into the notch 40 and thereby releasably locks the main control lever 18 in the neutral position until the lockout button 44 is again squeezed. As thus far described, the construction is generally conventional.

The main control lever 18, the control knob 28, and the lockout button 34 are arranged so that the control knob 28 can be conveniently located on either side of the main control lever 18, depending on the grip preference of the operator, clearance between the main control lever 18 and surrounding parts, etc., without removing the main control lever 18 and/or removing or relocating the locking arm 30. More specifically, the control knob 28 is comprised of two separate parts, the hand grip portion 29 comprising a first part and a second part or cover 50.

The hand grip portion 29 includes a hollow portion 52 which is open at the bottom to receive the lockout button 44 and is dimensioned to accommodate the movement of the lockout button 44 required for moving the locking arm 30 from the locking position to the released position. The outer end 54 of the hand grip portion 29 is closed. The inner end 56 of the hand grip portion 29 includes an offset lateral extension 58 having an outer surface which fits snugly into and extends through an aperture 62 provided in the upper end 20 of the main control lever 18 and further includes a shoulder 63 which abuts the upper end 20 of the main control lever 18 adjacent the aperture 62. The outer surface of the extension 58 and the main control lever aperture 62 (See FIGS. 5 and 6) preferably have a noncircular shape, e.g., are provided with matching flat areas 64 and 66, so that the control knob 28 will not rotate relative to the main control lever 18 after installation.

Figure 4:
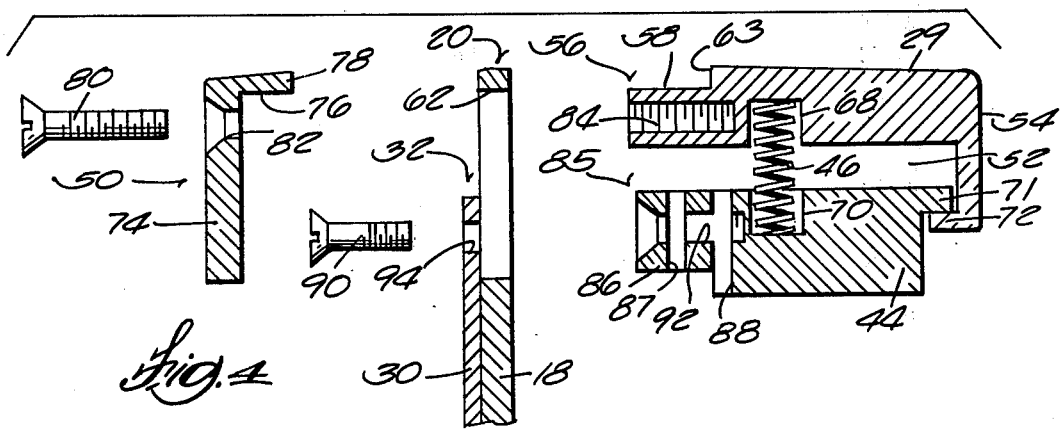
FIG. 4 is a partially exploded view of the components illustrated in FIG. 2.
Figure 3:
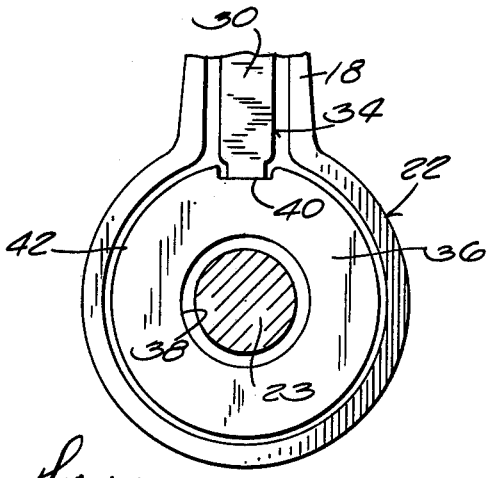
Figure 5:
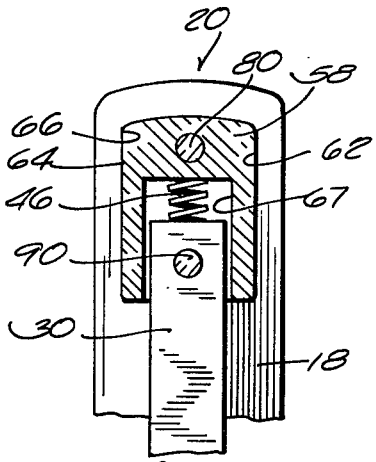
FIG. 5 is a sectional view taken generally along line 5—5 in FIG. 2.
Figure 6:
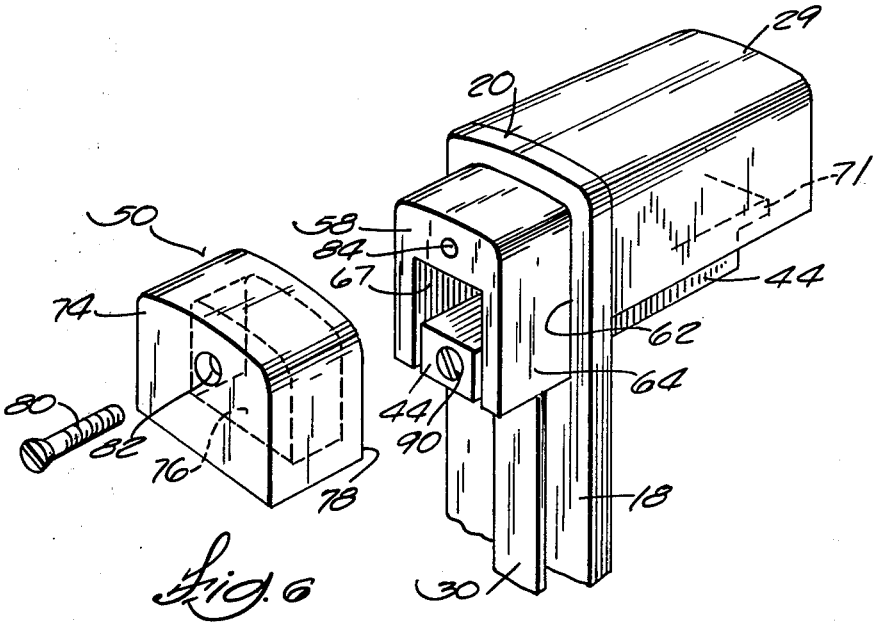
FIG. 6 is a perspective, partially exploded view of the components illustrated in FIG. 2.

As best shown in FIGS. 5 and 6, the extension 58 of the hand grip portion 29 has a downwardly open slot or recess 67 which receives the upper end 32 of the locking arm 30 and is dimensioned to accommodate movement of the locking arm 30 between the locking and released positions. Provided in the hand grip portion 29 and the lockout button 44 (FIG. 4) are respective pockets 68 and 70 which are alignable to receive and hold the opposite ends of the spring 46. The lockout button 44 has a laterally outwardly extending flange 71 which engages an internal lip 72 provided on the hand grip 26 to limit downward movement of the lockout button 44 as shown in FIGS. 2 and 7.

The cover 50 has a closed outer end 74 and a hollow portion 76 (FIGS. 4 and 6) which is dimensioned to fit over the portion of the hand grip extension 58 extending through the main control lever aperture 62 and to permit the inner end 78 of the cover 50 to abut the upper end 20 of the main control lever 18 adjacent the aperture 62 (See FIGS. 2 and 7). The cover 50 is removably fastened to the hand grip portion 29 by a screw 80 which extends through a countersunk aperture 82 in the outer end 74 of the cover 50 and is threaded into a tapped aperture 84 provided in the lateral extension 58 of the hand grip portion 29. Thus, the cover 50 serves both as a cover and a means for removably clamping the control knob 28 onto the main control lever 18.

The inner end 58 of the lockout button 44 includes an offset lateral extension 86 which extends through the control lever aperture 62. Located in the inner end 85 of the lockout button 44 is a pair of laterally spaced slots 87 and 88, each of which is adapted to receive the upper end 32 of the locking arm 30. The slots 87 and 88 are located on the opposite sides of the main control lever 18 so that the control knob 28 can be mounted either in the position shown in FIG. 2 or in the position shown in FIG. 7 without relocating the locking arm 30 or removing the main control lever 18. That is, the slot 87 is located in the lockout button extension 85 to receive the upper end 32 of the locking arm 30 when the lockout button 44 and the hand grip portion 29 are located on the outer or right side of the main control lever as shown in FIG. 2. The slot 88 is located to receive the upper end 32 of the locking arm 30 when these components are located on the inner or left side of the main control lever as shown in FIG. 7.

The upper end 32 of the locking arm 30 is removably fastened to the lockout button 44 (FIGS. 2, 4 and 7) by a screw 90 which is received in an aperture 92 provided in the inner end 85 of the locking button 44, extends through an aperture 94 provided in the upper end 32 of the locking arm 30, and is threaded into the main body of the lockout button 44. As best shown in FIGS. 2 and 7, the cover 50 extends over the innermost portion of the inner end 85 of the lockout button 44, thereby enhancing the esthetic appearance of the control knob 28 and providing protection against the entry of foreign objects which might obstruct proper operation of the lockout button 44.

In the event it is desired to relocate the control knob 28 from the position shown in FIG. 2 to the position in FIG. 7, or vice versa, the screw 80 and the cover 50 are removed, with the main control lever 18 in the neutral position, to expose the locking arm screw 90 which can then be removed. The lockout button 44 is then squeezed to compress the spring 46 and the upper end 32 of the locking arm 30 slides out of the slot 87. The hand grip portion 29, the lockout button 44 and the spring 46 can be removed from the main control lever aperture 62 as shown in FIG. 4. With the spring 46 compressed, the hand grip portion 29 and the lockout button 44 can be inserted into the control lever aperture 62 from the other side of the main control lever 18 and the slot 88 aligned with the upper end 32 of the locking arm 30. When the lockout button 44 is subsequently released, the spring 46 urges the lockout button 44 down over the upper end 32 of the locking arm 30 with the apertures 92 and 94 in the lockout button 44 and the locking arm 30 aligned, permitting installation of the locking arm screw 90. The cover 50 is then fitted over the extension 58 of the hand grip portion 29 and the cover screw 80 installed to complete the assembly. The main control lever 18 then is in a locked neutral position ready for operation.

Various of the features of the invention are set forth in the following claims.

What is claimed is:

1. A single lever control comprising a main control lever having an upper end and mounted for rotational movement relative to a neutral position, a control knob including a laterally extending hand grip portion, first fastening means for removably fastening said control knob on said upper end of said main control lever, and locking means for releasably locking said main control lever in the neutral position including a locking arm having upper and lower ends and slidably mounted on one side of said main control lever for reciprocative movement relative to the rotational axis of said main control lever between a locking position and a released position, detent means cooperating with said locking arm lower end for preventing movement of said main control lever from the neutral position when said locking arm is in the locking position and for permitting movement of said main control lever relative to the neutral position when said locking arm is in the released position, a lockout button located adjacent said hand grip portion of said control knob and movable relative thereto between a locking position and a released position, said lockout button including first and second laterally spaced slots located on the opposite sides of said main control lever and each adapted to receive said locking arm upper end such that, when said locking arm upper end is received in said first slot, a major portion of said hand grip portion and said lockout button extends laterally outwardly from one side of said main control lever and, when said locking arm upper end is received in said second slot, said major portion of said hand grip portion and said lockout button extends laterally outwardly from the opposite side of said main control lever, and second fastening means removably fastening said locking arm upper end to said lockout button, when said locking arm upper end is located in either of said first and second slots.

2. A single lever control according to claim 1 wherein said locking means includes means for biasing said locking arm toward the locking position.

3. A single lever control according to claim 1 including a housing having a side wall with an exterior surface and rotatably supporting said main control lever exteriorly of said side wall, wherein said detent means includes a circular plate mounted on said side wall exterior surface coaxially with the rotational axis of said main control lever and interposed said side wall and said main control lever, said plate having a peripheral edge including a notch which extends inwardly from said peripheral edge toward the rotational axis of said main control lever, which is located at a position corresponding to the neutral position of said main control lever, and which is adapted to receive said lower end of said locking arm, and wherein said detent means further includes means for biasing said locking arm toward said peripheral edge of said plate.

4. A single lever control according to claim 1 wherein said main control lever includes an aperture in said upper end, wherein said hand grip includes a lateral extension which is received in and extends through said main control lever aperture and further includes a portion which abuts one side of said main control lever adjacent said main control lever aperture, wherein said control knob further includes a cover which fits over the portion of said hand grip extension extending beyond said main control lever aperture and has an inner end which abuts the opposite side of said main control lever adjacent said main control lever aperture, and wherein said first fastening means removably fastens said cover to said hand grip extension and thereby secures said control knob on said main control lever.

5. A single lever control according to claim 4 wherein said main control lever aperture has a noncircular shape, and wherein the portion of said hand grip extension extending through said main control lever aperture has a shape corresponding to the shape of said main control lever aperture so as to substantially prevent rotation of said control knob relative to said main control lever.

6. A single lever control according to claim 4 wherein said lockout button has an extension which extends through said main control lever aperture, which includes one of said slots, and which includes an innermost end located beneath said cover, wherein said upper end of said locking arm has an aperture alignable with said slots, and wherein said second fastening means removably extends into said lockout button extension and through said locking arm aperture.

7. A single lever control comprising a housing including a side wall, a main control lever located exteriorly of said housing side wall, said control lever including an upper end, a lower end mounted on said housing for rotational movement of said main control lever relative to a neutral position, and an aperture in said upper end thereof, a control knob including a laterally extending hand grip portion having a lateral extension which is received in and extends through said main control lever aperture and a portion which abuts one side of said main control lever adjacent said main control lever aperture, and further including a cover which fits over the portion of said hand grip extension extending beyond said main control aperture and has an inner end which abuts the opposite side of said main control lever adjacent said main control lever aperture, first fastening means for removably fastening said cover to said hand grip extension and thereby securing said control knob on said main control lever, and locking means for releasably locking said main control lever in the neutral position including a locking arm having upper and lower ends and slidably mounted on one side of said main control lever for reciprocative movement relative to the rotational axis of said main control lever between a locking position and a released position, detent means cooperating with said locking arm lower end for preventing movement of said main control from the neutral position when said locking arm is in the locking position and for permitting movement of said main control lever relative to the neutral position when said locking arm is in the released position, a lockout button located adjacent said hand grip portion of said control knob and movable relative thereto between a locking position and a released position, said lockout button including first and second laterally spaced slots located on the opposite sides of said main control lever and each adapted to receive said locking arm upper end such that, when said locking arm upper end is received in said first slot, a major portion of said hand grip portion and said lockout button extend laterally outwardly from one side of said main control lever and, when said locking arm upper end is received in said second slot, said major portion of said hand grip portion and said lockout button extends laterally outwardly from the opposite side of said main control lever, and second fastening means removably fastening said locking arm upper end to said lockout button when said locking arm upper end is located in either of said first and second slots.

8. A single lever control according to claim 7 wherein said main control lever aperture has a noncircular shape and wherein the portion of said hand grip extension extending through said main control lever aperture has a shape corresponding to the shape of said main control lever aperture so as to substantially prevent rotation of said control knob relative to said main control lever.

9. A single lever control according to claim 8 wherein said lockout button has an extension which extends through said main control aperture, which includes one of said slots, and which includes an innermost end located beneath said cover, wherein said upper end of said locking arm has an aperture alignable with said slots, and wherein said fastening means removably extends into said lockout button extension and through said locking arm aperture.

10. A single lever control comprising a main control lever having an upper end and opposed sides and being mounted for rotational movement relative to a neutral position, locking means for releasably locking said main control lever in the neutral position, including a portion which is movable between a locking position and a released position, a control knob including a laterally extending hand grip portion and a lockout button located adjacent said hand grip portion and movable relative thereto between a locking position and a released position, and means for removably fastening said control knob on said upper end of said main control lever and for removably fastening said locking means portion on said lockout button whereby said control knob can be located on either of said opposite sides of said main control lever with a major portion of said hand grip portion and said lockout button extending laterally outwardly therefrom.

* * * * *